US009556734B2

(12) United States Patent
Carr

(10) Patent No.: US 9,556,734 B2
(45) Date of Patent: Jan. 31, 2017

(54) TUNNEL SEGMENT CROSS GASKET

(71) Applicant: Dennis Carr, Hudson, NH (US)

(72) Inventor: Dennis Carr, Hudson, NH (US)

(73) Assignee: CSI Tunnel Systems, Hudson, NH (US)

( * ) Notice: Subject to any disclaimer, the term of this patent is extended or adjusted under 35 U.S.C. 154(b) by 58 days.

(21) Appl. No.: 14/592,485

(22) Filed: Jan. 8, 2015

(65) Prior Publication Data

US 2015/0192014 A1 Jul. 9, 2015

Related U.S. Application Data

(60) Provisional application No. 61/925,036, filed on Jan. 8, 2014.

(51) Int. Cl.
*E21D 11/38* (2006.01)
*E21D 11/05* (2006.01)

(52) U.S. Cl.
CPC ..... *E21D 11/385* (2013.01); *E21D 11/05* (2013.01); *E21D 11/38* (2013.01)

(58) Field of Classification Search
CPC ..... E21D 11/05; E21D 11/38; E21D 11/385; E21D 11/388; E21D 5/12; E21D 11/083; E21D 11/18; E21D 11/40; E02D 29/16; E02B 3/16
USPC ..... 277/641, 644, 645, 650, 921; 405/135, 405/146, 147, 152
See application file for complete search history.

(56) References Cited

U.S. PATENT DOCUMENTS

| | | | |
|---|---|---|---|
| 4,199,158 | A | 4/1980 | de Munck |
| 4,299,399 | A | 11/1981 | Haaland |
| 4,630,630 | A | 12/1986 | Reynolds et al. |
| 4,824,289 | A | 4/1989 | Glang et al. |
| 4,886,303 | A | 12/1989 | Carson et al. |
| 5,074,711 | A | 12/1991 | Glang et al. |
| 5,316,351 | A | 5/1994 | Czimny et al. |
| 5,888,023 | A | 3/1999 | Grabe et al. |
| 6,129,485 | A | 10/2000 | Grabe et al. |
| 6,238,139 | B1 | 5/2001 | Glang et al. |
| 6,267,536 | B1 | 7/2001 | Adachi et al. |
| 6,434,904 | B1 | 8/2002 | Gutschmidt et al. |
| 6,575,664 | B1 | 6/2003 | Kassel et al. |
| 6,592,296 | B2 | 7/2003 | Gutschmidt et al. |
| 6,612,585 | B2 | 9/2003 | Grabe |
| 6,739,632 | B1 | 5/2004 | Thomas et al. |
| 8,376,412 | B2 | 2/2013 | Johnson |
| 2008/0012239 | A1 | 1/2008 | Corbett, Jr. et al. |
| 2009/0148658 | A1 | 6/2009 | Gutschmidt et al. |

(Continued)

OTHER PUBLICATIONS

Garrod, B., Gregor, T., "Recent Developments in North America in the Design of Precast Concrete Tunnel Linings", North American Tunneling 2008 Proceedings, p. 177.*

(Continued)

*Primary Examiner* — Sunil Singh
*Assistant Examiner* — Carib Oquendo
(74) *Attorney, Agent, or Firm* — Fay Sharpe LLP

(57) ABSTRACT

A tunnel segment radial cross gasket includes a base side or face and a top side or face. A plurality of longitudinally extending spaced parallel grooves are disposed on the base side. One or more longitudinally oriented bores, which are spaced from each other, extend through the gasket. The top face of the gasket includes first and second sections, with the second section being tapered or angled in relation to the first section.

18 Claims, 11 Drawing Sheets

(56) References Cited

U.S. PATENT DOCUMENTS

| | | | |
|---|---|---|---|
| 2012/0121338 | A1 | 5/2012 | Hentschel et al. |
| 2012/0328369 | A1 | 12/2012 | Hoeft et al. |

OTHER PUBLICATIONS

Datwyler, "Seals for Tunnel Construction", Circa 2013, 12 pages.

* cited by examiner

TUNNEL SEGMENT CROSS GASKET

CROSS REFERENCE TO RELATED PATENTS AND APPLICATIONS

This application claims priority to and the benefit of the filing date of U.S. Provisional Patent Application Ser. No. 61/925,036, filed Jan. 8, 2014, which application is hereby incorporated by reference.

The present disclosure pertains to gaskets or seals for sealing tunnel segment joints. More particularly, the present disclosure pertains to tunnel segment cross gaskets for retarding a seepage of fluids between tunnel segments.

In the construction of tunnels, the contact surfaces of two abutting tunnel segments, which are generally made of precast concrete, must be sealed against the inflow and outflow of water and other liquids. Such tunnels can be subway tunnels, river crossing tunnels, road and railway tunnels, cable tunnels, waste water and water supply tunnels, among other types. As a general rule, the water pressure against which the seal is provided can be in the range of between 1 and 4 bar, but water pressures are site specific dependent on geological conditions. Reliable sealing should be insured between tunnel segments so as to prevent or retard the ingress and egress of fluids such as water.

For sealing rectangular tunnel segments with circumferential receiving grooves, usually four sealing profiles are secured in respective circumferential receiving grooves of each segment. The several tunnel segments are then arranged with abutting seals or gaskets, located in their receiving grooves, and are assembled to form a ring of the tunnel. Several rings together form a complete tunnel tube. The seals or gaskets are facing each other between the several segments of each tunnel ring.

In order to improve the sliding properties of the sealing profiles of the facing tunnel gaskets, the contact surfaces are lubricated. When the tunnel segments are assembled, however, the lubricant is allowed to exit from the contact surfaces sideways and the adhesive friction between the contact surfaces of the facing gaskets increases due to a growing force of compression, thereby allowing a good seal to occur.

Recently, some municipalities have added a requirement that the tunnel segments also be provided with a radial cross gasket which would be disposed so as to extend between the conventional circumferentially extending gaskets located near the top and bottom faces of each tunnel segment. Thus, the radial cross gasket is to be oriented along a radius of the tunnel ring. One function of such gaskets would be to retard the seepage of gases, such as methane, into the tunnel.

One difficulty with designing a gasket for this purpose is that the final segment, or key segment, of each tunnel ring needs to be slid in a longitudinal direction during installation. Any typical gasket placed on a radial face of a tunnel key segment, or the adjacent two tunnel segments between which the key segment is slid, would not function properly. It would overturn as the opposing gaskets are brought into contact with each other when mating the gaskets to form a seal.

It would thus be desirable to provide a cross gasket which would overcome the foregoing difficulties and others as the tunnel segments are brought into contact with each other to build tunnel rings.

SUMMARY

The present disclosure concerns a gasket design for radial cross gaskets for tunnel segments. Such gaskets are installed in a direction generally perpendicular to a longitudinal axis of a tunnel ring formed from a plurality of segments.

According to one aspect, a tunnel segment cross gasket comprises a gasket body including a bottom face configured to be positioned against a surface of an associated tunnel segment, a top face located opposite the bottom face and including a tapered portion and a sealing portion, the sealing portion being adapted for sealing against an adjacent surface, a left face extending between the bottom face and the top face, and a right face extending between the bottom face and the top face; wherein the gasket includes a plurality of spaced grooves opening to the bottom face; and wherein a plurality of bores extend through the gasket body, at least two of the plurality of bores having different cross-sectional shapes or sizes, and at least one of the plurality of bores being located entirely between the tapered portion of the top face and the bottom face.

The cross-sectional shapes of the plurality of bores can include at least one of, or each of, a triangular shape, a semi-circular shape, or a trapezoidal shape. The grooves and bores can extend in a common direction. The top face can include a portion thereof that is oriented parallel with the bottom face when the gasket is in an uncompressed state, and a portion thereof that is angled with respect to the bottom face when the gasket is in the uncompressed state such that the left face is larger than the right face. A larger number of bores can be located between the bottom surface and the portion of the top face that is parallel with the bottom face, than between the bottom face and the angled portion of the top face. The left face can include a first section that tapers outwardly away from the bottom face and a second section that is concave from the first section to the top face. The grooves opening to the bottom face can be uniform in shape and size. The tunnel gasket body can comprise ethylene propylene diene monomer (EPDM) rubber.

In accordance with another aspect, a tunnel segment for a tunnel ring composed of a plurality of tunnel segments comprises a tunnel segment body, a groove located in a radial surface of the tunnel segment body, and a tunnel gasket disposed in the groove. The tunnel gasket includes a gasket body having a bottom face positioned against a surface of the groove, a top face located opposite the bottom face and including a tapered portion and a sealing portion for sealing against a surface of an adjacent tunnel segment, a left face extending between the bottom face and the top face, a right face extending between the bottom face and top face, a plurality of spaced grooves opening to the bottom face, and a plurality of bores extending through the gasket body, at least two of the plurality of bores having different cross-sectional shapes or sizes, and at least one of the bores being located entirely between the tapered portion of the top face and the bottom face.

In accordance with another aspect, a sealing system is provided for sealing adjacent precast tunnel segments that can be installed by longitudinally translating the segments into position. The sealing system comprises first and second tunnel segment gaskets, each of the first and second tunnel segment gaskets comprising a gasket body including a bottom face configured to be positioned on a radial face of an associated respective tunnel segment, a top face located opposite the bottom face including a tapered portion and a sealing portion being adapted for sealing against the sealing portion of the top face of the other gasket, a left face extending between the bottom face and the top face, and a right face extending between the bottom face and top face, a plurality of spaced grooves opening to the bottom face, and a plurality of bores which extend through the gasket body, at least two of the plurality of bores having different cross-sectional shapes or sizes, and at least one of the bores being located entirely between the tapered portion of the top face and the bottom face. When the first and second gaskets are installed in opposite orientations in radial grooves in respective adjacent tunnel segments, the tunnel segments can be longitudinally translated in an axial direction into position such that the tapered surfaces of each tunnel gasket make initial contact with each other before the sealing surfaces of each gasket are aligned.

In accordance with yet another aspect, a method of assembling a tunnel ring composed of a plurality of tunnel segments, a final segment of which being longitudinally translated into position between adjacent tunnel segments is provided. The method comprises providing a final segment including a radial cross gasket having a gasket body with a bottom face positioned against a bottom surface of a groove in a radial surface of the final segment, a top face located opposite the bottom face for sealing against a surface of an adjacent tunnel segment, a left face extending between the bottom face and the top face, a right face extending between the bottom face and top face, a plurality of spaced grooves opening to the bottom face, and a plurality of bores which extend through the gasket body, at least two of the plurality of bores having different cross-sectional shapes or sizes, and longitudinally translating the final segment into position to complete the tunnel ring.

DETAILED DESCRIPTION

Figure 1:
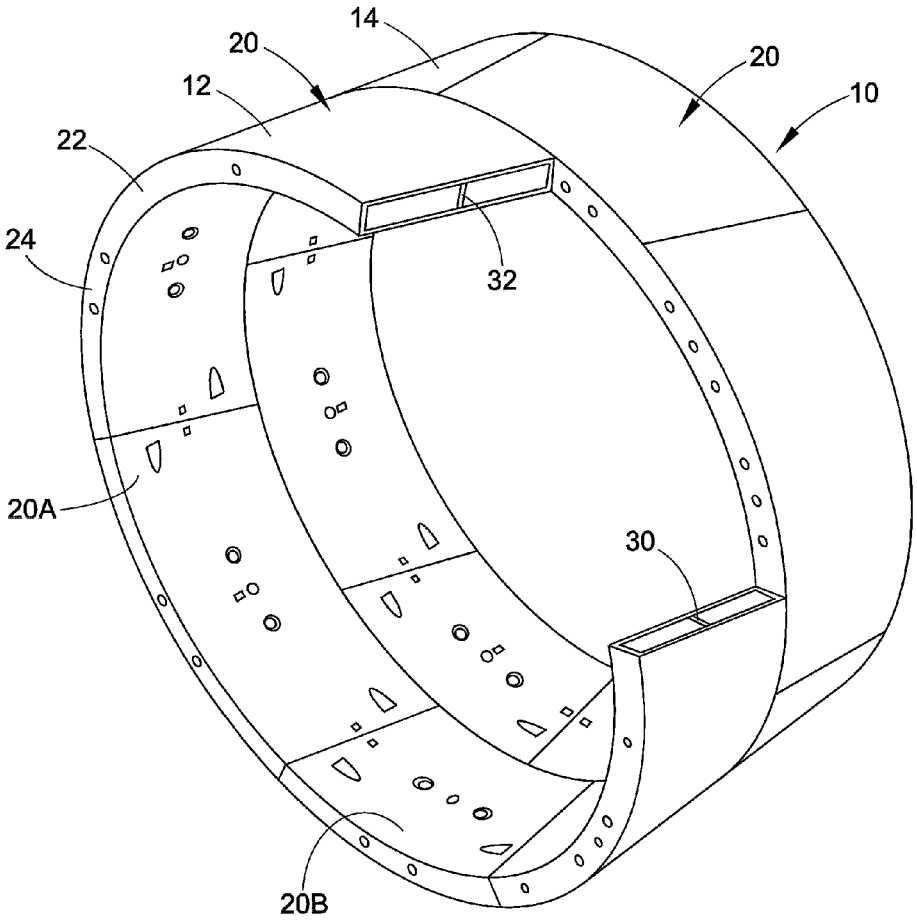
FIG. 1 is a perspective view of two adjacent tunnel rings, each comprised of a plurality of tunnel segments according to the present disclosure.

With reference now to FIG. 1, a tunnel 10 includes several rings such as at 12 and 14. Each ring is comprised of a plurality of tunnel segments 20. While most of the tunnel segments are generally rectangular in shape, such as segment 20A, one segment of each tunnel ring is generally trapezoidal in shape such as segment 20B. One of the trapezoidal segments is the last installed tunnel segment of each ring, and needs to be slid into place. The segments 20A have sides which are generally not parallel but form acute and obtuse angles in order to allow the tunnel to bend when the segments are assembled into rings and the rings are installed one after the other, according to the relative angular position of each segment. Provided on each segment are first and second longitudinally extending joints 22 (intrados side) and 24 (extrados side). One is located adjacent each of the inner and outer faces of the tunnel segment. Also provided for each segment are radial cross joints 30 and 32.

In one embodiment, the rings 12 and 14 each include six segments, namely, four rhomboidal segments and two trapezoidal segments such that the four rhomboidal segments each take up 67.5° of the 360° circumference of the tunnel ring, whereas the two trapezoidal segments take up approximately 45° each.

Figure 2:
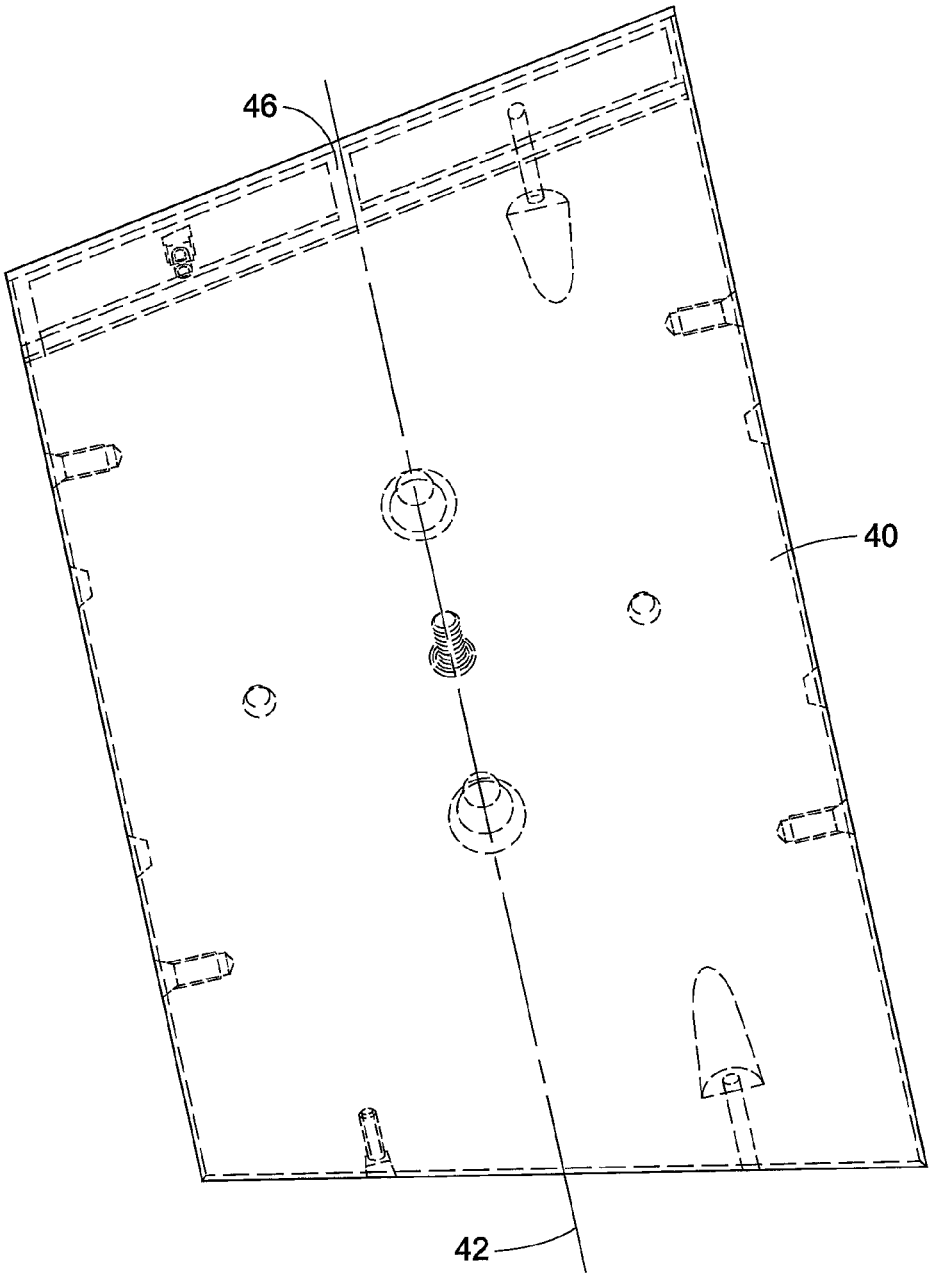
FIG. 2 is an enlarged top plan view of a tunnel segment according to the present disclosure.
Figure 3:
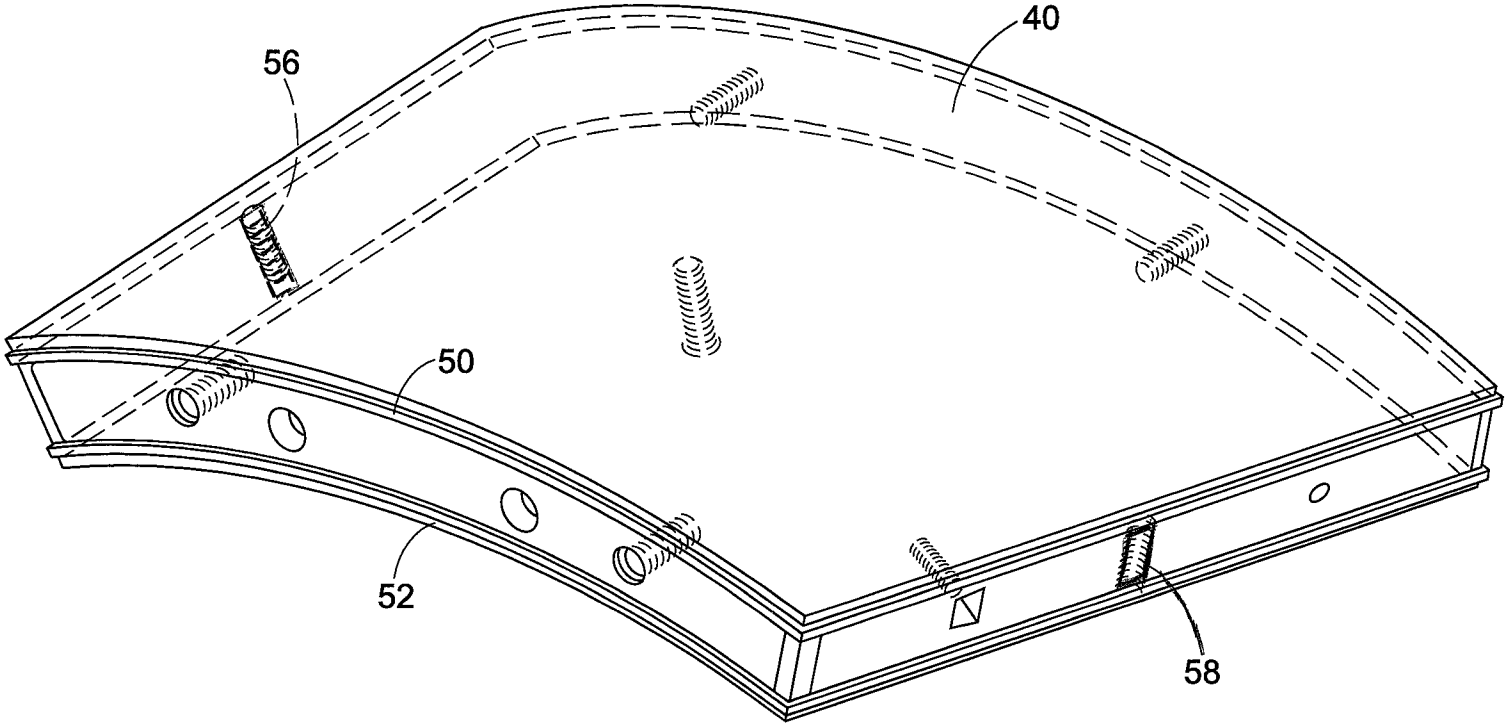
FIG. 3 is a slightly reduced perspective view of the tunnel segment of FIG. 2.

One of the trapezoidal segments 20B is illustrated in FIG. 2 and identified by the numeral 40. The segment includes a segment centerline 42, along which extends a groove 46 on the radial face of the segment accommodating a gasket for a cross joint. With reference now also to FIG. 3, each segment 40 includes first (which is termed extrados) and second (which is termed intrados) longitudinal gaskets 50 and 52 which are spaced from each other and are disposed adjacent the top (extrados) and bottom (intrados) surfaces of the tunnel segment 40. These gaskets are located in grooves defined in the tunnel segment. Also provided are first and second radial cross gaskets 56 and 58. The gaskets 56 and 58 are termed radial cross gaskets because they extend along radii extending from the axial centerline of the tunnel ring. The gaskets are positioned in grooves defined on opposed side faces of the tunnel segment 40.

Figure 4:
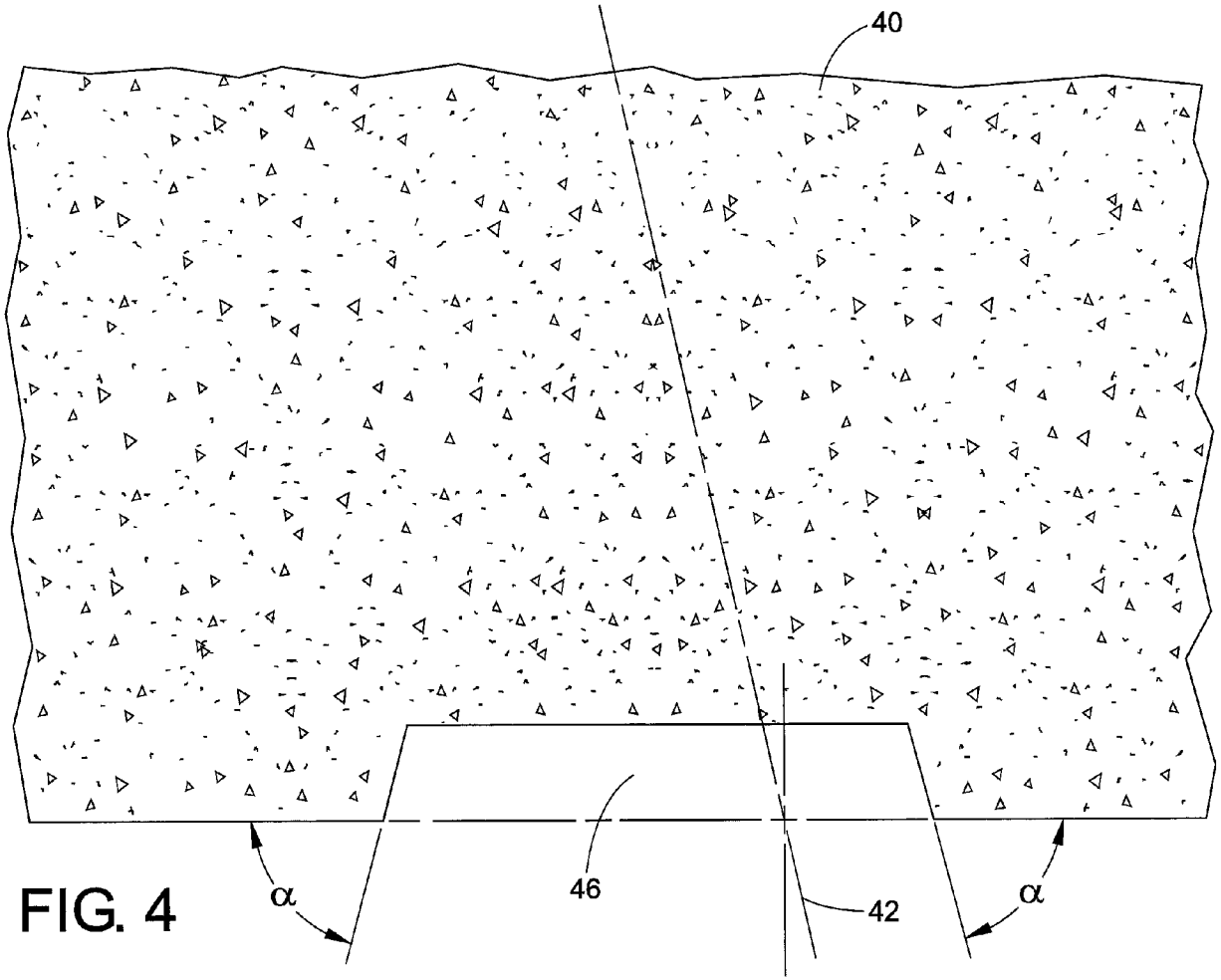
FIG. 4 is a greatly enlarged cross-sectional view of a portion of the tunnel segment of FIG. 2.

With reference now also to FIG. 4, one groove 46 for accommodating a radial cross gasket can be 0.39 inches (10 millimeters) deep, 2.05 inches (52 millimeters) long, and may have side edges which are oriented at a taper angle of approximately 15° so that the angle $\alpha$ (alpha) between the side edge of the groove and the face of the tunnel segment can be on the order of 75°.

Figure 5:
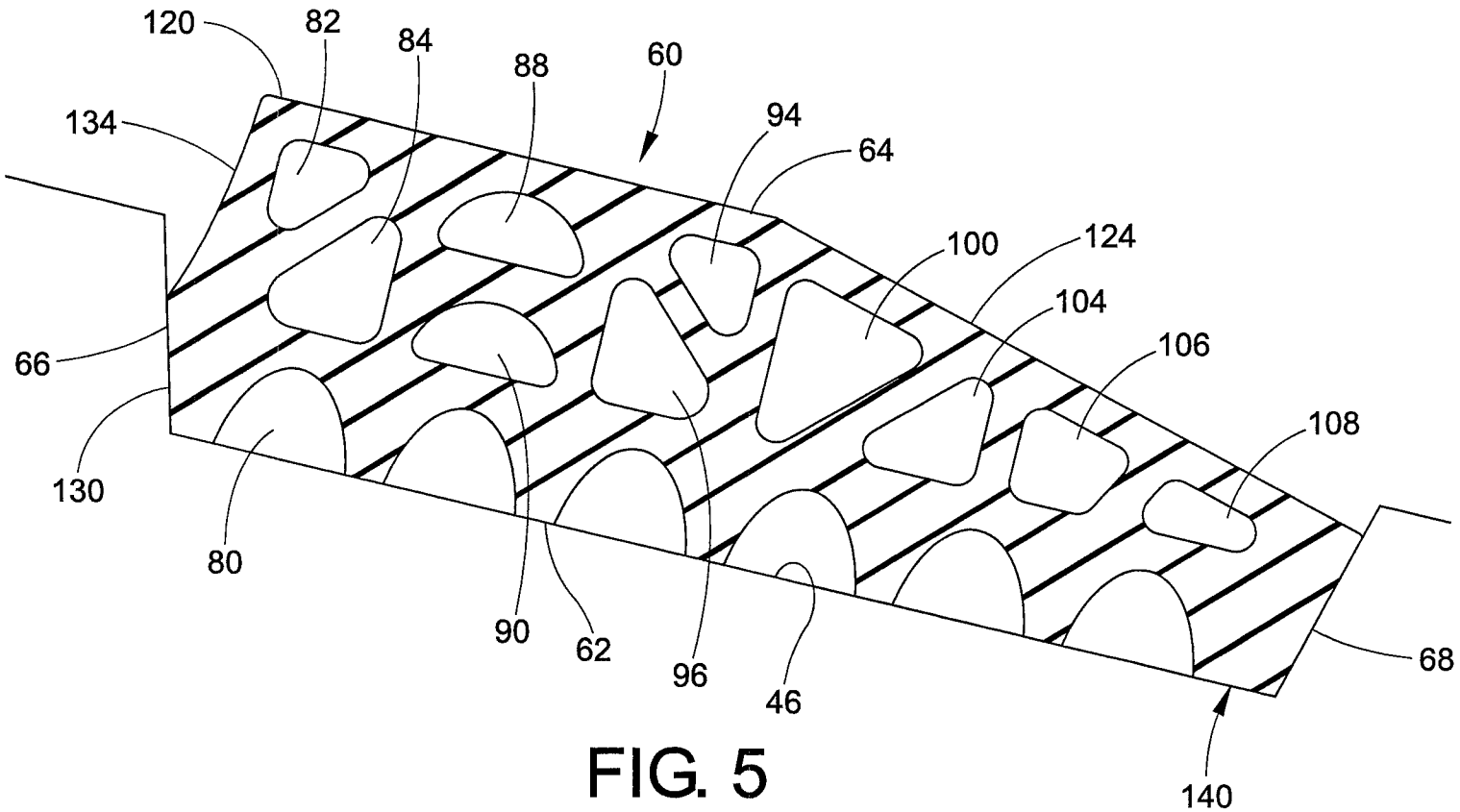
FIG. 5 is an enlarged view of the tunnel segment of FIG. 4 with a gasket according to the present disclosure being located in a groove of the tunnel segment.

With reference now also to FIG. 5, a gasket which is adapted to be positioned in the groove 46 is a segment which can include a gasket body 60. In this embodiment the gasket comprises a bottom face 62, a top face 64, a left face 66 and a right face 68. Defined on the bottom face are a plurality of spaced oval-shaped grooves 80. Extending through the gasket body 60 are a plurality of bores. In this embodiment, the bores include a first generally triangularly shaped bore 82 and a second generally triangularly shaped bore 84. It is apparent that the second bore 84 is larger than the first bore 82 and is separated therefrom by an internal wall of the gasket. Located adjacent the first and second bores 82 and 84 are a pair of semi-circular bores 88 and 90 that are radially spaced from each other and axially spaced from the first and second triangular bores as well. Located on an opposite side of the pair of semi-circular bores are third and fourth triangular bores 94 and 96. In this embodiment, the fourth bore 96 is larger than the third bore 94. The third and fourth bores 94 and 96 can be mirror images of the first and second bores 82 and 84. Located adjacent the third and fourth triangular bores, is a fifth triangular bore 100. In this embodiment, the fifth bore is larger than are the third and fourth bores. Located adjacent the fifth bore is a sixth triangular bore 104 and, located next to the sixth bore 104 is a trapezoidally shaped seventh bore 106. Finally, an eighth generally triangular bore 108 is located adjacent the trapezoidal bore 106. It should be appreciated from FIG. 5 that all of the bores 82-108 are positioned away from the bottom face 62 of the gasket body and located above the several grooves 80 disposed on the gasket body bottom face. It should be appreciated that the several bores and grooves can be axially aligned with each other. In other words, they can extend in a common direction.

With continued reference to FIG. 5, the gasket body top face 64 is comprised of two sections, namely, a first generally planar section 120 that is oriented generally parallel to the gasket body bottom face 62 and a second top face section 124 which is oriented at an acute angle in relation to the gasket body bottom face. In other words, the gasket top face has a tapered section 124. For example, the taper angle can be about 13.6°. The tapered gasket top face illustrated in FIG. 5 has functional advantages for the radial cross gasket disclosed herein.

The gasket body left face 66 comprises two sections, namely, a first section 130 which tapers outwardly from the gasket body bottom face 62 and a second section 134 which tapers inwardly from the left face first section 130.

In order to secure the gasket body 60 remain in place in the groove 46, a conventional adhesive 140 will be employed or applied at a location between the gasket and the groove.

Figure 6C:
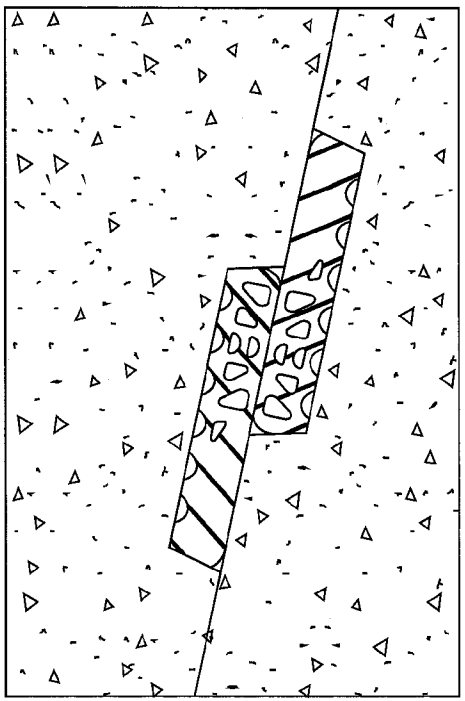
FIG. 6C is a cross sectional view of the tunnel segments of FIG. 6A in a third, assembled or closed position.
Figure 6B:
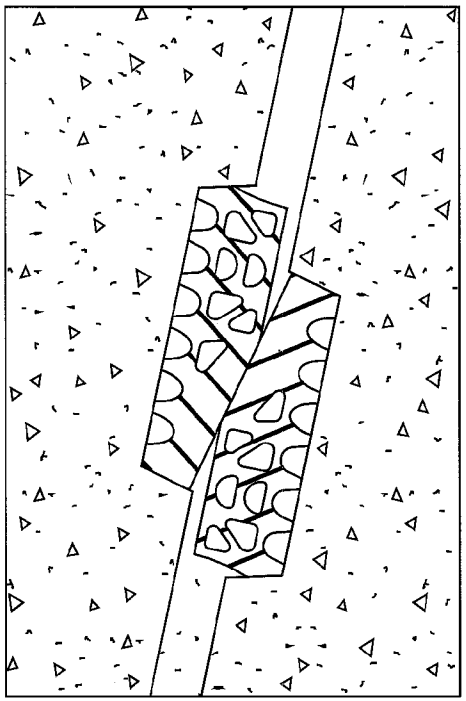
FIG. 6B is a cross sectional view of the tunnel segments of FIG. 6A being located in a second, closer, position.
Figure 6A:
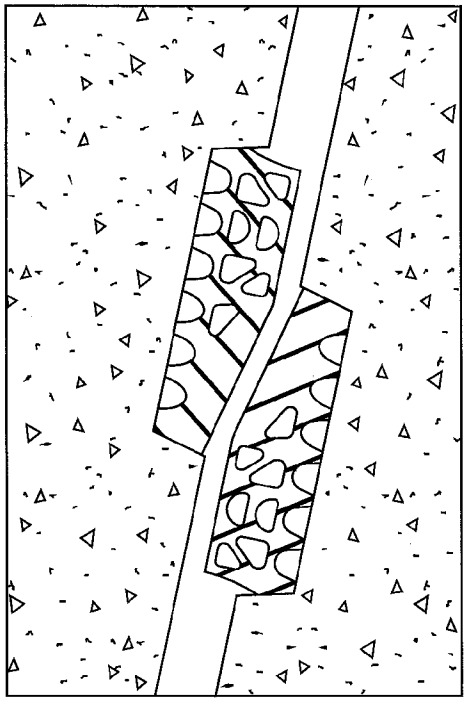
FIG. 6A is a cross sectional view of a pair of adjoining tunnel segments including respective gaskets, with the tunnel segments being located in a first spaced position.

With reference now to FIG. 6A, as a pair of tunnel segments 40 are advanced towards each other, the gaskets will move from an uncompressed position, illustrated in FIG. 6A, to a compressed position, illustrated in FIG. 6C. To this end, when the tunnel segments are at about two inches from the closed position, as illustrated in FIG. 6A, the gaskets are uncompressed and each gasket still retains its sloping or tapered face 124 as well as its horizontal face 120. With reference now to FIG. 6B, as the tunnel segments are brought closer to each other, the opposing tapered faces 124 of adjacent gasket bodies contact each other. As the key tunnel segment advances forward, the gasket bodies begin to slide in relation to each other. At this point, the tunnel segments are at approximately 1.63 inches from the closed position.

With reference now to FIG. 6C, when the tunnel segments are in their closed position, the gaskets are fully compressed and the tapered faces of the respective gaskets are no longer visible. When the gaskets are fully compressed as shown in FIG. 6C, the top face first sections 120 are located opposite each other and the top face second sections now contact the concrete of the adjacent tunnel segment. That is, as the key tunnel segment is slid into place, the tapered portion of the top surface of each gasket slides beyond the flat or sealing portion of the other gasket until the flat or sealing portion of the gaskets are aligned.

Figure 7:
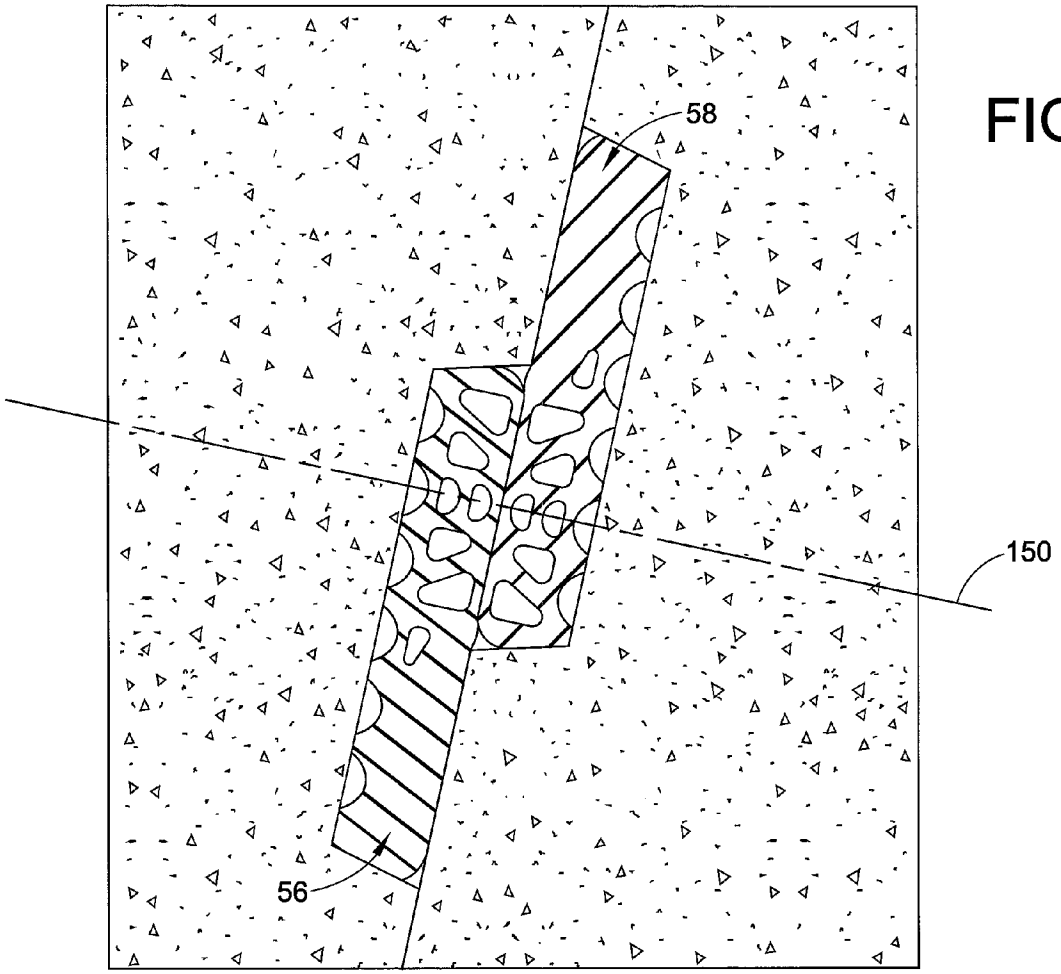
FIG. 7 is an enlarged view of a tunnel segment of FIG. 6C.

With reference now to FIG. 7, it can be seen that the centerline of the gaskets when they are fully engaged is oriented at an angle in relation to the respective tunnel segment. Also, the two cross gaskets 56 and 58 are now arranged so that the respective bores 88 and 90 (which are still shown as being semi-circular for ease of understanding but which in actuality are no longer visible because they are compressed) of each gasket are aligned and the centerline 150 passes therethrough. Some of the bores will become invisible or at least hard to see when the gasket is compressed. It should be appreciated that FIG. 7 depicts one possible cross-sectional configuration upon compression of two facing gaskets. The compressed gaskets may have cross-sections that may look different from the depiction of FIG. 7.

In one embodiment, the gasket first generally planar section 120 can have a thickness of about 0.65 in. (16.5 mm) when uncompressed. When compressed, the gasket first section 120 will only extend to the height of the bore. In this embodiment, the gasket first section will thus have a thickness of 0.39 in. (10 mm). The first section 120 can extend about 1.02 in. (26.0 mm) of the total width of 2.05 in. (52 mm) of the gasket. Thus, each of the first and second sections 120 and 124 of the gasket can have approximately the same width.

The obtuse intersection of the gasket upper or top face is the solution developed in order to allow the installation of the final segment, or key tunnel segment, without overturning the gasket in the radial direction as two radial cross gaskets meet in compression upon the insertion of the tunnel ring's key segment.

Figure 8:
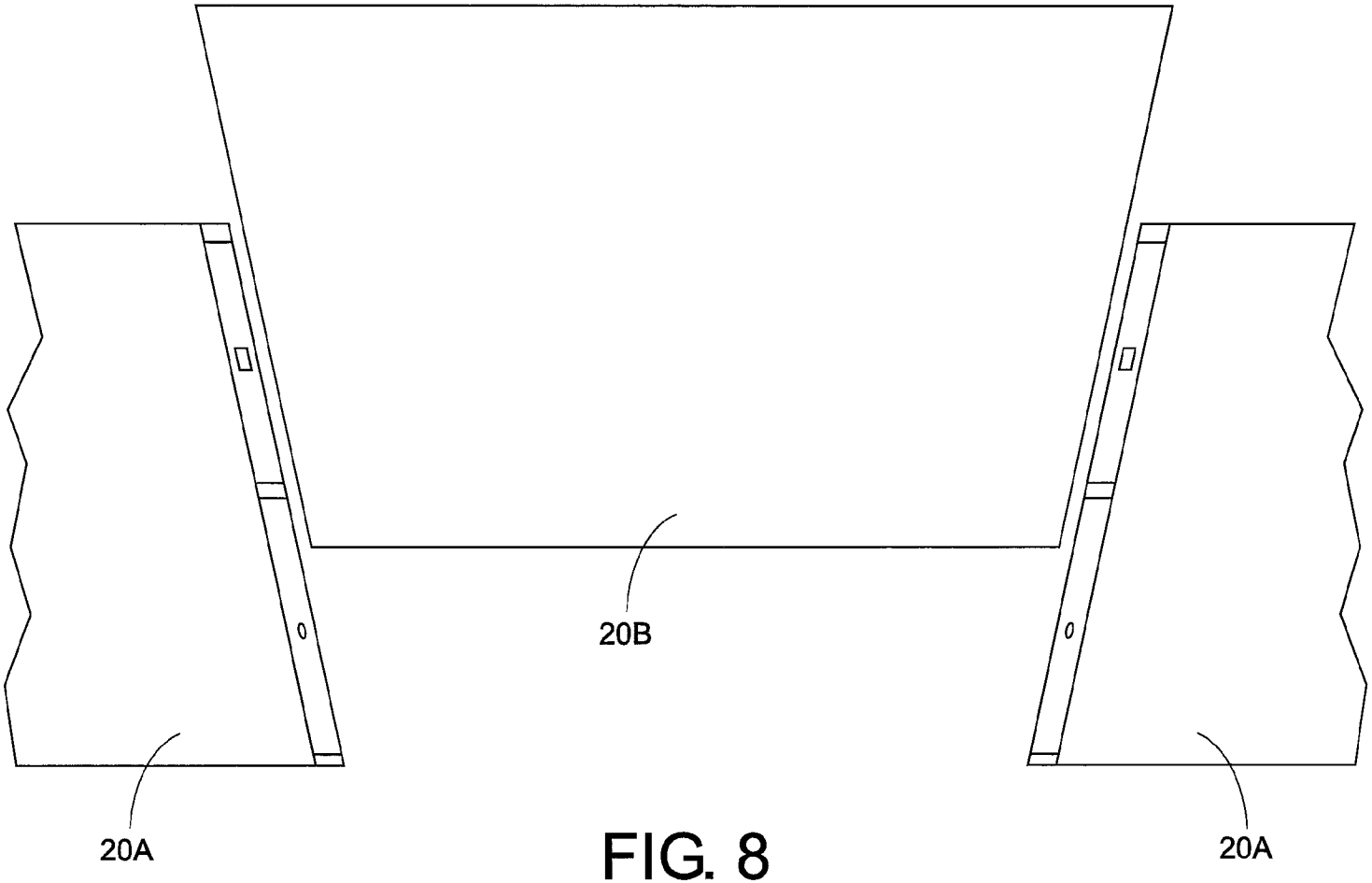
FIG. 8 is a top plan view in a pullback condition showing the installation of a key tunnel segment according to the present disclosure.
Figure 9:
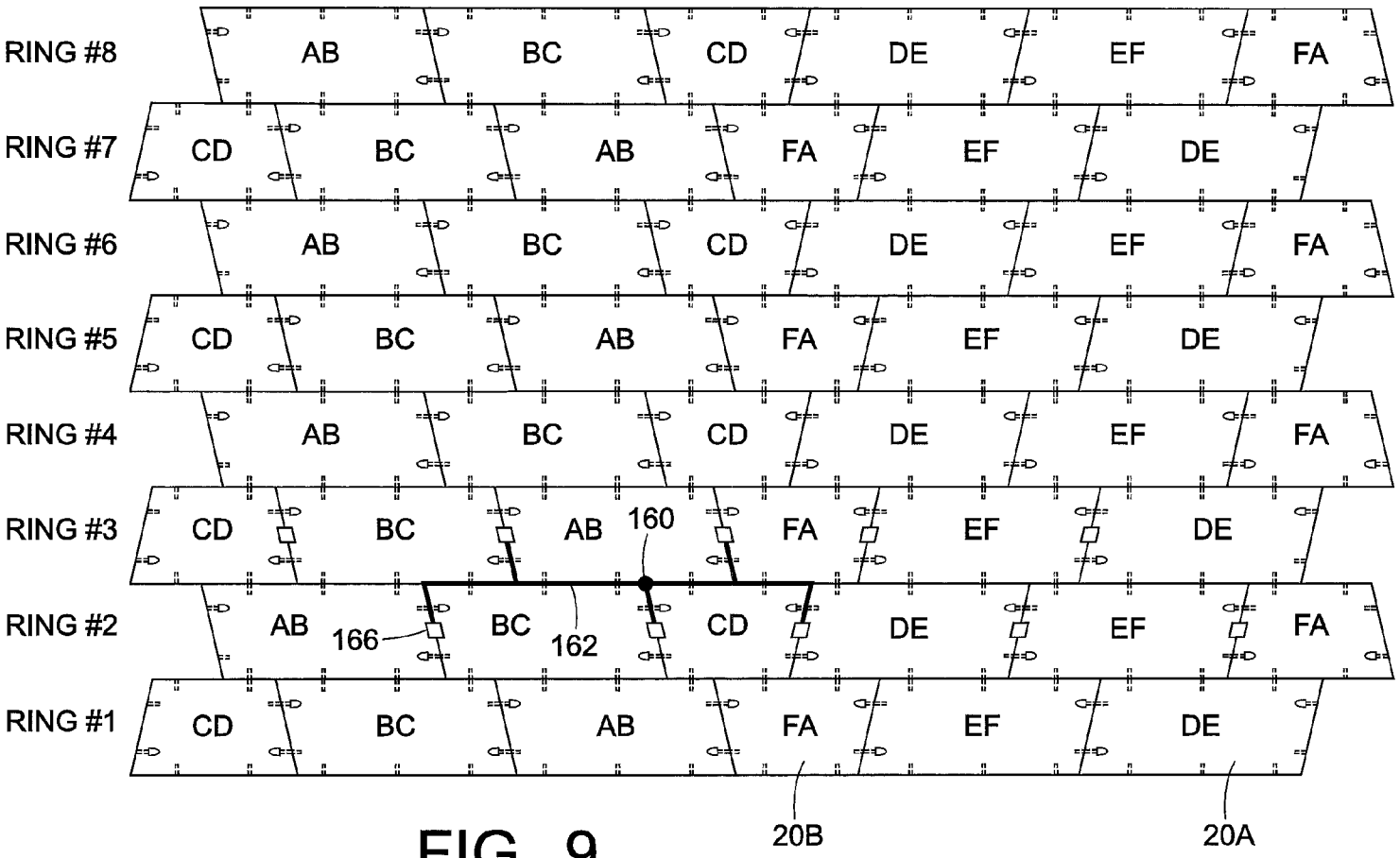
FIG. 9 is a flat developed view of an eight ring tunnel section illustrating a possible leak condition and the way in which a joint formed by a pair of tunnel segments with radial cross gaskets prevents a flow of fluids between tunnel rings.

With reference now to FIG. 8, a trapezoidal key tunnel segment 20B is illustrated in a pullback condition in relationship to a pair of tunnel segments 20A. With reference now also to FIG. 9, it can be seen that in one embodiment there are four parallelogram shaped tunnel segments 20A and two trapezoidal shaped tunnel segments 20B.

For example, the radial cross gaskets have been illustrated on rings 2 and 3 in FIG. 9. While the cross gaskets are not illustrated in the other rings, it should be appreciated that similar cross gaskets are located there as well. The numeral 160 identifies a fluid leak which propagates along one joint between a pair of adjacent segments of tunnel rings #2 and #3. The fluid flows along a flow path 162. It should be appreciated that the flow path ends at a joint 166 that is located between each two segments 20A or two segments 20A and 20B. Thus, the joint formed by the pair of mating cross gaskets prevents any further propagation of fluid along the flow path 162, thereby localizing the leak. Put another way, the leak is not allowed to flow to any of the other tunnel segments from rings #2 and #3, and, as the fluid flows around the joint between these two rings, it will flow away from the tunnel segments via gravity and seep into the adjacent soil once the fluid is no longer on top of the tunnel segments.

Figure 10:
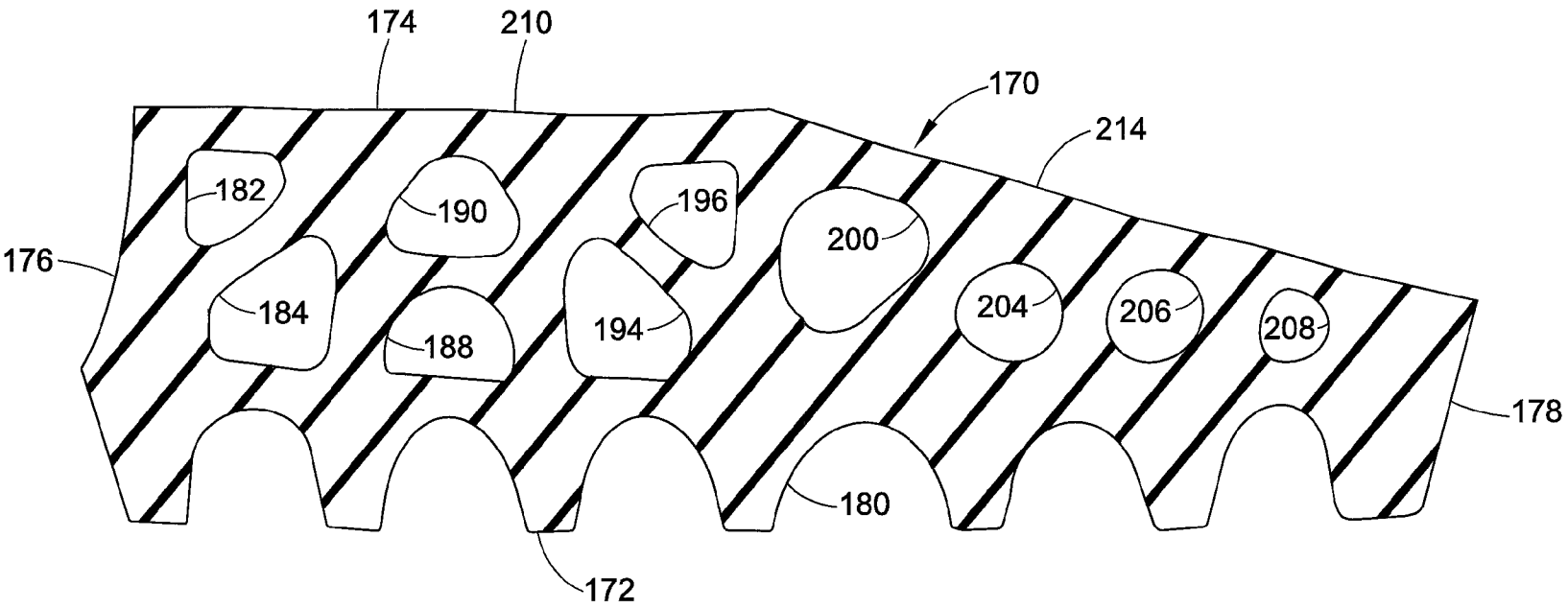
FIG. 10 is a greatly enlarged cross sectional view of a radial cross gasket according to another embodiment of the present disclosure.

With reference now to FIG. 10, another embodiment of a radial cross gasket according to the present disclosure is there illustrated. In this embodiment, a gasket body 170 includes a bottom face 172, a top face 174, a left face 176, and a right face 178. A plurality of spaced grooves 180 is defined in the gasket bottom face 172. A first and a second triangularly shaped bore extends through the gasket body. These bores are located adjacent to the left face 176. Spaced therefrom are first and second semi-circular shaped bores 188 and 190. Spaced therefrom are third and fourth triangular shaped bores 194 and 196. Further spaced along the gasket body is a seventh somewhat oval shaped bore 200. Spaced further along the gasket body 170 are three generally rounded bores 204, 206 and 208.

As in the previous embodiment, the gasket body 170 has a top face 174 which includes a first section 210 and a second section 214. The second section 214 is angled in relation to the first section 212, thus giving the gasket a tapered shape. The top face second section 214 serves as a ramp when the two mating gaskets are joined to each other as illustrated in the embodiment of FIGS. 6A-6C and FIG. 7. In this embodiment, the bores 200, 204, 206 and 208 are located or positioned beneath the top face second section 214.

Figure 11:
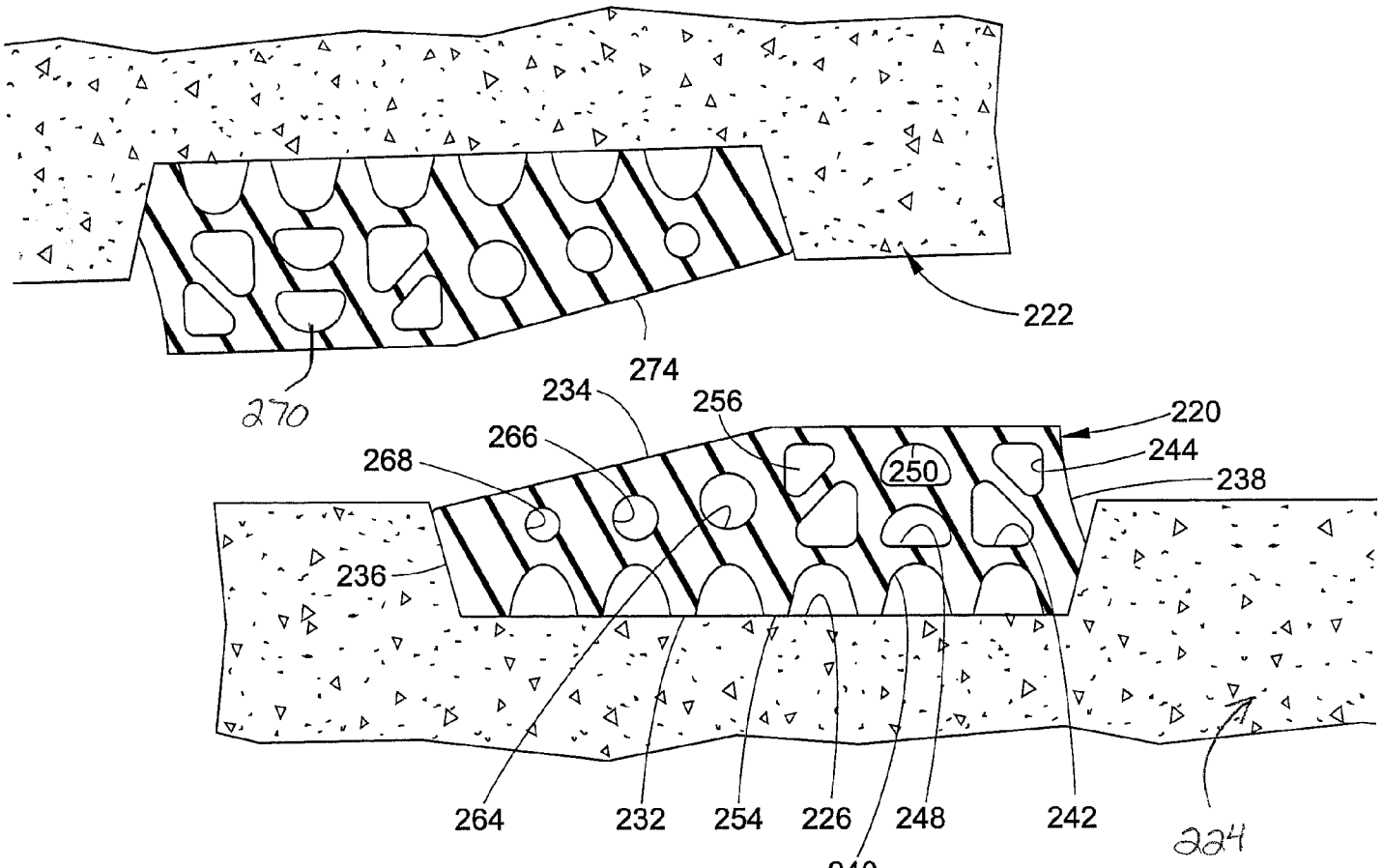
FIG. 11 is a cross sectional view through a pair of adjoining tunnel segments including respective radial cross gaskets according to yet another embodiment of the present disclosure.

With reference now to FIG. 11, yet another embodiment of a gasket construction is there illustrated. In this embodiment, a first tunnel segment 222 and a second tunnel segment 224 each include a radial cross joint such as the joint 226. The facing gasket bodies are identical in this embodiment and only the lower gasket body illustrated in FIG. 11 will be described herein, it being appreciated that the upper gasket body is a mirror image thereof.

A gasket body 220 includes a bottom face 232, a top face 234, a left face 236 and a right face 238. A plurality of spaced grooves 240 is defined in the gasket body bottom face 232. First and second triangular shaped bores extend through the gasket body adjacent the right face 238 thereof. Spaced therefrom are a pair of semi-circular bores 248 and 250. Spaced from such bores are third and fourth generally triangularly shaped bores 254 and 256. In this embodiment, three generally round bores 264 and 266 and 268 are also defined in the gasket body 220. It can be seen in this embodiment, that the bores 264-268 are of differing sizes with the first bore 264 being the largest and the third bore 268 being the smallest.

The gasket body top face 234 comprises a first section 270 and a second section 274 which is angled or tapered in relation to the first section. The round bores 264, 266 and 268 are located beneath the top face second section 274.

In this embodiment, the cross joint 226 is about 0.39 inches (10 millimeters) in depth and the height of the gasket is about 0.65 inches (16.5 millimeters) in height.

It should be appreciated that the number and configuration of the several bores extending through the gasket may change so as to "tune" the compressibility of the gasket. What is significant is that the facing gasket top surfaces are provided with or exhibit tapered sections. These allow a relative sliding motion between the two gaskets as they approach each other so that the gaskets do not overturn as the tunnel segments they are mounted to approach each other.

The gaskets may be made from a suitable elastomeric material such as, for example, ethylene propylene diene monomer (EPDM) rubber. One or more other elastomers having a Shore A hardness in the range of 30 to 70 can also be used. Thus, many elastically deformable synthetic materials are usable.

What has been disclosed is a seal or gasket for a sealing arrangement employed for shaft or tunnel construction which includes abutting structural components having a gap therebetween. The sealing arrangement is comprised of two components which lie against each other forming a joint. Each component has a base body including at least one bore which is surrounded by a bore wall. The gasket includes a base side or face and a top side or face. The top face includes a tapered section.

The present disclosure has been described with reference to several embodiments. Obviously, modifications and alterations will occur to others upon the reading and understanding of the preceding detailed description. It is intended that the present disclosure be construed with all such modifications and alterations insofar as they come within the scope of the appended claims or with the equivalents thereof.

What is claimed is:

1. A tunnel segment cross gasket comprising:

a gasket body including a bottom face configured to be positioned against a surface of an associated tunnel segment, a top face located opposite the bottom face and including a tapered portion and a sealing portion, the sealing portion being adapted for sealing against an adjacent surface, a left face extending between the bottom face and the top face, and a right face extending between the bottom face and the top face;

wherein the gasket includes a plurality of spaced grooves opening to the bottom face;

wherein a plurality of bores extend through the gasket body, at least two of the plurality of bores having different cross-sectional shapes or sizes, and at least one of the plurality of bores being located entirely between the tapered portion of the top face and the bottom face; and wherein the top face includes a portion thereof that is oriented parallel with the bottom face when the gasket is in an uncompressed state, and a portion thereof that is angled with respect to the bottom face when the gasket is in the uncompressed state such that the left face is larger than the right face.

2. The tunnel segment cross gasket of claim 1, wherein the cross-sectional shapes of the plurality of bores include at least one of a triangular shape, a semi-circular shape, or a trapezoidal shape.

3. The tunnel segment cross gasket of claim 1, wherein the cross-sectional shapes of the plurality of bores include each of a triangular shape, a semi-circular shape, and a trapezoidal shape.

4. The tunnel segment cross gasket of claim 1, wherein the grooves and bores extend in a common direction.

5. The tunnel segment cross gasket of claim 1, wherein a larger number of bores are located between the bottom surface and the portion of the top face that is parallel with the bottom face, than between the bottom face and the angled portion of the top face.

6. The tunnel segment cross gasket of claim 1, wherein the left face includes a first section that tapers outwardly away from the bottom face and a second section that is concave from the first section to the top face.

7. The tunnel segment cross gasket of claim 1, wherein the grooves opening to the bottom face are uniform in shape and size.

8. The tunnel segment cross gasket of claim 1, wherein the tunnel gasket body comprises ethylene propylene diene monomer (EPDM) rubber.

9. A tunnel segment for a tunnel ring composed of a plurality of tunnel segments, the tunnel segment comprising:

a tunnel segment body;

a groove located in a radial surface of the tunnel segment body; and a tunnel gasket disposed in the groove;

wherein the tunnel gasket includes a gasket body having a bottom face positioned against a surface of the groove, a top face located opposite the bottom face and including a portion angled with respect to the bottom face when the gasket is in an uncompressed state and a portion oriented parallel with the bottom face when the gasket is in the uncompressed state for sealing against a surface of an adjacent tunnel segment, a left face extending between the bottom face and the top face, a right face extending between the bottom face and top face wherein the left face is larger than the right face when the gasket is in the uncompressed state, a plurality of spaced grooves opening to the bottom face, and a plurality of bores extending through the gasket body, at least two of the plurality of bores having different cross-sectional shapes or sizes, and at least one of the bores being located entirely between the angled portion of the top face and the bottom face.

10. The tunnel segment of claim 9, wherein the cross-sectional shapes of the plurality of bores include at least one of a triangular shape, a semi-circular shape, and a trapezoidal shape.

11. The tunnel segment of claim 9, wherein the cross-sectional shapes of the plurality of bores include each of a triangular shape, a semi-circular shape, and a trapezoidal shape.

12. The tunnel segment of claim 9, wherein the grooves and bores extend in a common direction.

13. The tunnel segment of claim 9, wherein a larger number of bores are located between the bottom face and the portion of the top face that is oriented parallel with the bottom face, than between the bottom face and the angled portion of the top face.

14. A sealing system for sealing adjacent precast tunnel segments that can be installed by longitudinally translating the segments into position, the sealing system comprising:

first and second tunnel segment gaskets, each of the first and second tunnel segment gaskets comprising a gasket body including a bottom face configured to be positioned on a radial face of an associated respective tunnel segment, a top face located opposite the bottom face wherein the top face includes a portion thereof that is oriented parallel with the bottom face when the gasket is in an uncompressed state, and a portion thereof that is angled with respect to the bottom face when the gasket is in the uncompressed state, the top face being adapted for sealing against the top face of the other gasket, a left face extending between the bottom face and the top face, and a right face extending between the bottom face and top face, a plurality of spaced grooves opening to the bottom face, and a plurality of bores which extend through the gasket body, at least two of the plurality of bores having different cross-sectional shapes or sizes, and at least one of the bores being located entirely between the tapered portion of the top face and the bottom face; and whereby when the first and second gaskets are installed in opposite orientations in radial grooves in respective adjacent tunnel segments, the tunnel segments can be longitudinally translated in an axial direction into position such that the angled surfaces of each tunnel gasket top face make initial contact with each other before the top faces of the first and second gaskets are fully aligned.

15. The sealing system of claim 14, wherein the cross-sectional shapes of the plurality of bores of at least one of the first and second gaskets include at least one of a triangular shape, a semi-circular shape, and a trapezoidal shape.

16. The sealing system of claim 14, wherein the cross-sectional shapes of the plurality of bores of at least one of the gaskets include each of a triangular shape, a semi-circular shape, or a trapezoidal shape.

17. The sealing system of claim 14, wherein the grooves and bores of at least one of the first and second gaskets extend in a common direction.

18. A method of assembling a tunnel ring composed of a plurality of tunnel segments, a final segment of which being longitudinally translated into position between adjacent tunnel segments, the method comprising:

providing a final segment including a radial cross gasket having a gasket body with a bottom face positioned against a bottom surface of a groove in a radial surface of the final segment, a top face located opposite the bottom face for sealing against a surface of an adjacent tunnel segment wherein the top face includes a portion thereof that is oriented parallel with the bottom face when the gasket is in an uncompressed state, and a portion thereof that is angled with respect to the bottom face when the gasket is in the uncompressed state, a left face extending between the bottom face and the top face, a right face extending between the bottom face and top face wherein the left face is larger than the right face when the gasket is in the uncompressed state, a plurality of spaced grooves opening to the bottom face, and a plurality of bores which extend through the gasket body, at least two of the plurality of bores having different cross-sectional shapes or sizes; and longitudinally translating the final segment into position to complete the tunnel ring.

* * * * *